US006102561A

United States Patent [19]

King

[11] Patent Number: 6,102,561

[45] Date of Patent: Aug. 15, 2000

[54] DEVICE FOR ENHANCING HEAT TRANSFER AND UNIFORMITY OF A FLUID STREAM WITH LAYERS OF HELICAL VANES

[75] Inventor: Leonard Tony King, Long Beach, Calif.

[73] Assignee: Komax Systems, Inc., Wilmington, Calif.

[21] Appl. No.: 09/002,618

[22] Filed: Jan. 5, 1998

[51] Int. Cl.[7] ..... B01F 5/06

[52] U.S. Cl. ..... 366/181.5; 366/339; 138/38; 165/109.1

[58] Field of Search ..... 366/318, 319, 366/321, 336, 338, 339, 181.5; 165/109.1, 156, 160, 184; 198/662, 663, 669, 676; 138/37, 38, 39; 100/145, 146

[56] References Cited

U.S. PATENT DOCUMENTS

| | | | |
|---|---|---|---|
| 612,181 | 10/1898 | Spurrier | 366/318 |
| 745,074 | 11/1903 | Roche | 366/318 |
| 1,496,345 | 6/1924 | Lichtenthaeler | 366/181.5 |
| 1,776,135 | 9/1930 | Smith . | |
| 1,893,484 | 1/1933 | Belt | 165/160 |
| 2,784,948 | 3/1957 | Pahl et al. | 366/181.5 |
| 3,643,735 | 2/1972 | Huggins | 165/184 |
| 4,053,141 | 10/1977 | Gussefeld | 366/339 |
| 5,046,548 | 9/1991 | Tilly | 366/339 |
| 5,583,240 | 12/1996 | Asher et al. . | |

*Primary Examiner*—Charles E. Cooley
*Attorney, Agent, or Firm*—Malcolm B. Wittenberg

[57] ABSTRACT

A device for enhancing the mixing and uniform distribution of fluids within a conduit. The device includes a core pipe which can optionally receive a first fluid and series of helically wound vanes wrapped about the core pipe employing the core pipe as a mandrel. Fluids entering the conduit are mixed by virtue of passing over and about the helically wound vanes while heat transfer can be effected by heat passing between the mandrel and the fluid passing over the vanes. Ideally, the vanes are wrapped about the mandrel at an angle of approximately 45° thereto and adjacent layers of vanes are wrapped about the mandrel at opposite signs so that interstices are ideally created between vanes of approximately 90°.

9 Claims, 4 Drawing Sheets

DEVICE FOR ENHANCING HEAT TRANSFER AND UNIFORMITY OF A FLUID STREAM WITH LAYERS OF HELICAL VANES

TECHNICAL FIELD OF THE INVENTION

The present invention is directed to a device for enhancing fluid mixing and uniform fluid distribution within the confines of a conduit. The device is secondarily, in certain defined embodiments, capable of effecting heat transfer from a first fluid medium to a second fluid medium and for introducing and mixing a first fluid medium within a second fluid medium and for mixing and distributing various fluids throughout the length of the present device.

BACKGROUND OF THE INVENTION

Static mixers have long been employed to promote and to enhance the mixing of one or more fluids within a defined space. Mixers can contain active elements such as paddles and rotors, although it is quite common to provide static elements whereby the turbulent flow of fluids in and around these elements enhance fluid mixing without the need for moving parts which inherently add to the cost of mixing operation both in terms of power requirements and labor intensive maintenance procedures. Many static mixers rely on mixing element configurations which present a set of interstices to the product flow. Elements of this type divide a fluid stream along the mixing path and recombine locally created substreams into a more homogeneous mixture.

It is also common practice to provide, within a conduit, a series of tubes or pipes to effect heat transfer between a product stream and a fluid medium contained within tubes in contact with the flow of the fluid product.

The art is replete with both patented and non-patented literature describing various approaches to motionless mixer design. One of the earliest devices was developed at the Arthur D. Little Co. and licensed to others. The Arthur D. Little design employed helical mixing elements which acted to divide a passing fluid into two streams. When "n" of such elements were installed in a series, they produced a total of $2^n$ divisions of the stream. Applicant's own static mixer, as described in U.S. Pat. No. 3,923,288, dated Dec. 2, 1975, is of this type. There have been other motionless mixer designs, all of which have been a variation on the basic theme of fluid division and recombination. For example, U.S. Pat. No. 4,511,258, dated Apr. 16, 1985, discloses a motionless mixing device having mixing elements formed by deforming flat stock material. Sulzer Brothers Ltd. was awarded U.S. Pat. No. 4,211,277 on Jul. 8, 1980, for a heat exchanger with a plurality of fittings which are disposed in the flow passage. The fittings were taught to be constructed of groups of webs with each group disposed in spaced parallel relation in an angular orientation to the axis of the flow passage. Each group of webs was disposed in crossing relation to the webs of an adjacent group to improve heat transfer with reduced pressure loss. Koch Engineering Co. was granted U.S. Pat. No. 4,643,584 on Feb. 17, 1987, for a motionless mixer for use in mixing turbulent flow streams in a conduit. The mixer of the '584 patent comprised at least first and second pairs of plate elements, the plate elements composed of semi-elliptical portions disposed at an angle of about 45° from the axis of the conduit, the first and second pairs disposed at an angle of about 90° with respect to each other in the conduit with the plate elements of each pair overlapping the plate elements of an adjacent pair. It was the goal of the '584 patent to provide sets of interstices to divide local flow into two streams and to divert each stream away from the other to develop a lateral or radial flow distribution.

Although the above-described prior art representing a small segment of the available teachings of motionless mixers perform the mixing function to a certain degree, none of the existing types of static mixing devices produce a uniform distribution of interstices throughout the available volume within the conduit, Applicant has now found that by providing such a uniform distribution of interstices, uniform mixing is enhanced by maximizing the volume utilization in terms of interstice mixing regions for a given pressure drop. As such, Applicant's present design provides for a more efficient mixing apparatus.

SUMMARY OF THE INVENTION

The present invention deals with a device for enhancing uniformity of fluids within a moving fluid stream within the confines of a conduit. The conduit is characterized as having a substantially circular cross section, longitudinal axis, fluid inlet and fluid outlet. The device itself comprises a core pipe located at the approximate longitudinal axis of the conduit, the core pipe acting as a mandrel for the application of at least first and second layers of vanes. The first layer of vanes is helically wound about the core pipe, the inner diameter of the first layer of vanes being substantially coextensive with the outer diameter of the core pipe wherein each of the vanes of the first layer are configured as being of a substantially constant angle to the longitudinal axis of the conduit. The second layer of vanes is helically wound about the first layer of vanes such that the second layer of vanes has an inner diameter substantially coextensive with the outer diameter of the first layer of vanes. Again, the second layer of vanes is configured as having a substantially constant angle to the longitudinal axis of the conduit noting that the sign of each layer of vanes is opposite to the adjacent layer of vanes so that interstices are created between adjacent layers of vanes which are substantially constant along the length of the core pipe.

DETAILED DESCRIPTION OF THE INVENTION

Figure 1A:
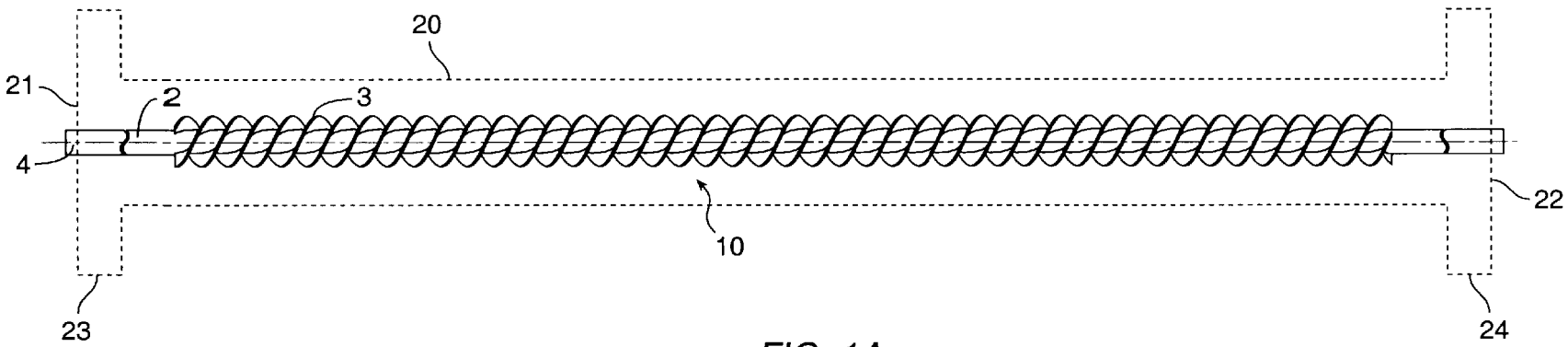
FIG. 1*a* is a plan view of a partial construction of a device pursuant to the present invention.

As noted previously, the present invention is directed to a device for enhancing uniformity of fluids within a moving fluid stream within the confines of a conduit. In referring to FIG. 1*a,* conduit 20 is shown in phantom having a substantially circular cross section, a longitudinal axis 4, a fluid inlet 21 and a fluid outlet 22. The conduit can be provided with flanges 23 and 24 for attachment to adjacent sections of conduit (not shown) which may or may not contain additional mixing or heat transfer elements.

The device of the present invention comprises core pipe 2 located at the approximate longitudinal axis 4 of conduit 20. Core pipe 2 acts as a mandrel for the application of a first layer of vanes 3 which, as shown in FIGS. 1*a,* 1*b* and 2, are helically wound about core pipe 2, the inner diameter of the first set of vanes 3 being substantially coextensive with the outer diameter of core pipe 2.

Figure 1B:
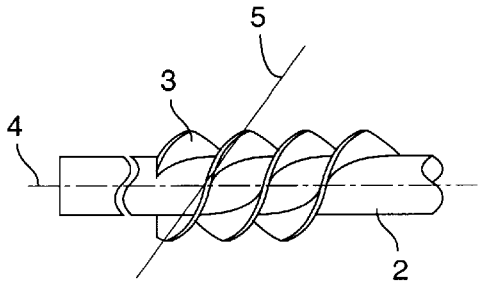
FIG. 1*b* is an expanded segment of the core pipe and first layer of vanes of FIG. 1A, again shown in plan view.

As best seen by reference to FIG. 1*b,* each of vanes 3, helically wound about core pipe 2 are of a substantially constant angle to longitudinal axis 4. This angle is shown by line 5 taken along an edge of one of vanes 3. Ideally, again, as shown in FIG. 1*b,* this constant angle is selected as being 45° to longitudinal axis 4.

Figure 2:
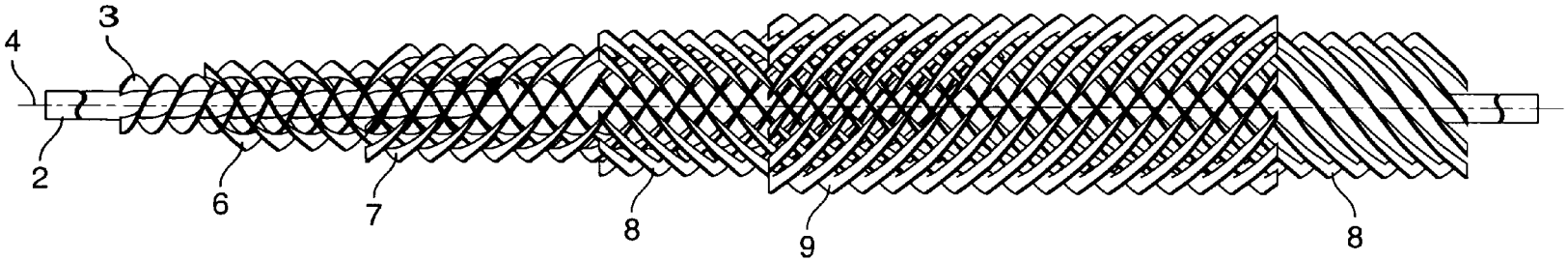
FIG. 2 is a depiction, in plan view, of the buildup of additional layers of vanes in producing the mixing device of the present invention.

FIG. 2 shows the build-up of additional sets of vanes over core pipe 2 which, again, is used as a mandrel for first set of vanes 3. As noted, second layer of vanes 6 is wound about first layer of vanes 3 such that second layer of vanes 6 have an inner diameter substantially coextensive with the outer diameter of said first layer of vanes 3. As noted, the vanes of the second layer 6 are of a substantially constant angle to longitudinal axis 4 wherein the sign of each layer of vanes 3, 6, 7, 8, 9, etc., are opposite to the adjacent layer of vanes so that interstices are created between adjacent layers of vanes which are substantially constant along the length of core pipe 2.

Figure 3:
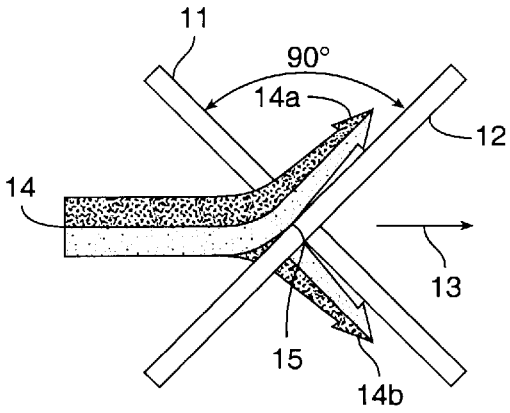
FIG. 3 is a schematic representation showing the interaction of a fluid stream when confronting interstices created by the buildup of layers of vanes.
Figure 4:
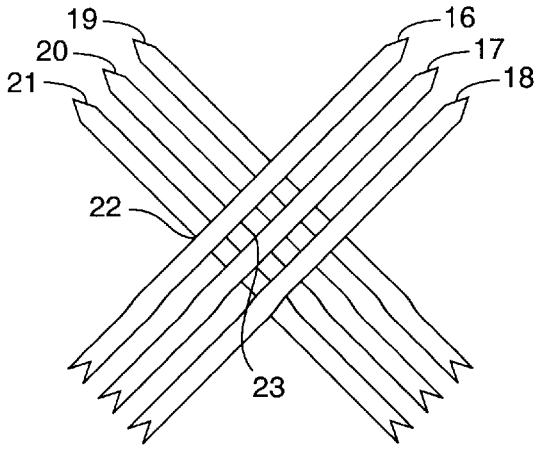
FIG. 4 shows, in schematic, how various interstices are created by the establishment of layers of vanes pursuant to the present invention.

The creation of interstices is shown schematically in FIGS. 3 and 4. As noted in FIG. 3, interstice 15 is created at the point of contact between vanes 11 and 12. If each of said vanes 11 and 12 are of approximately 45° to the longitudinal axis of the core pipe and are of an opposite sign, interstice 15 is thus at a 90° angle. Again referring to FIG. 3, as fluid 14 passes by interstice 15 in the direction of arrow 13, fluid 14 is separated into two fluid streams 14*a* and 14*b* which later recombine enhancing uniformity of fluid 14 as it travels within conduit 20.

FIG. 4 simply shows the number of interstices 22, 23, etc., created by adjacent layers of vanes 15, 17, 18, 19, 20 and 21. Each of the created interstices is of a constant uniform angle and each acts as a site for the division and recombination of the fluid stream as it passes within conduit 20. As noted previously, such a geometry provides for maximum fluid mixing at a minimum pressure drop known to the present Applicant.

Up to this point, core pipe 2 has been described as being nothing more than a mandrel for establishing the diameter of first set of vanes 3 and subsequent sets of vanes built thereon as best shown in FIG. 2. However, the mandrel can perform additional function as well. For example, mandrel 2 can be configured of a hollow stock acting as a conduit for fluid contained therein. If the fluid is of a significantly different temperature than the fluid passing within conduit 20, the present invention can act as a heat transfer device, the heat transfer being enhanced by reduction of any laminar film which ordinarily would reside at the surface of core pipe 2 because of the mixing action resulting from adjacent layers of vanes as described above.

Figure 5:
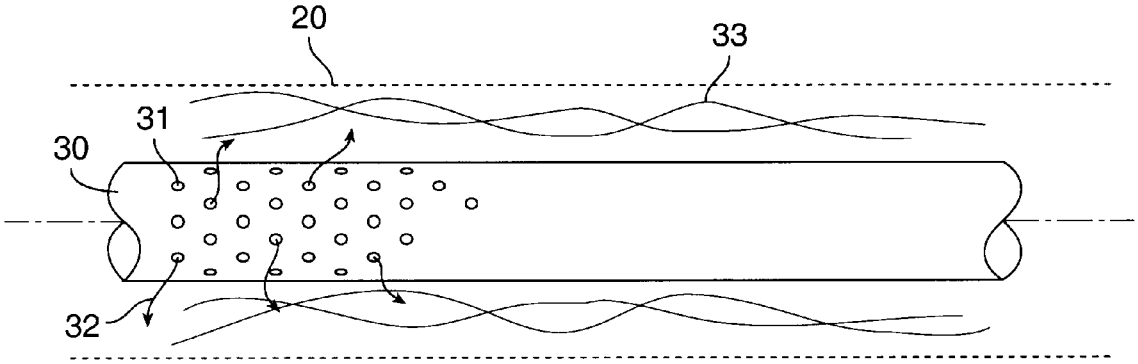
FIG. 5 is a plan view showing a segment of a core pipe having holes configured therein for the transfer of fluid from within the core pipe to the interior of the conduit.
Figure 6:
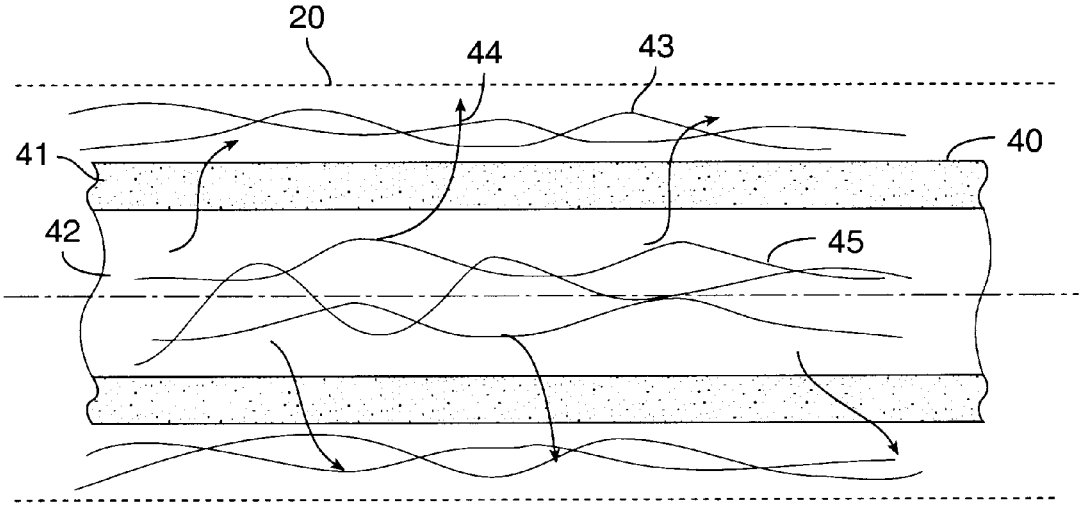
FIG. 6 is a cut-away view of yet another core pipe having porous walls for transferring fluid from within the core pipe to the interior of the conduit.

Additional preferred embodiments are shown in FIGS. 5 and 6. FIG. 5 shows conduit 30 as a substitute for core pipe 2 as shown in the previous figures. In this instance, core pipe 30 is intended to carry a fluid (not shown) which is caused to pass through the side wall of core pipe 30 through holes 31 schematically shown by arrows 32. This fluid is intended to commingle with fluid 33 passing within conduit 20. As such, the present invention, in this preferred embodiment, acts not only as a means for enhancing uniformity of fluid 33 but as a mixing device for uniformly distributing fluid within core pipe 30 therein. As noted, for the sake of simplicity, vanes have been eliminated from FIGS. 5 and 6 although, in operation, such vanes would be included as an integral part of the present invention.

Turning to FIG. 6, core pipe 40 is shown in cut-away view illustrating interior 42 containing fluid 45 therein. As in the embodiment of FIG. 5, fluid contained within the interior of core pipe 40 shown schematically as element 45 can pass through the side walls 41 of core pipe 40 which, in this instance, consists of a porous wall. As such, fluid 45 passes through porous wall 41 as shown by arrows 44 and is thus uniformly mixed with fluid 43 contained within the conduit by virtue of the motionless mixing apparatus shown in FIG. 2. Manufacture of porous wall 41 can be accomplished as taught in U.S. Pat. No. 5,583,240 dated Dec. 10, 1996, the disclosure of which is hereby incorporated by reference.

In appreciation of the following illustration, the recited terms have indicated meanings:

L=overall length of mixer $d_c$=outside diameter of core pipe or rod w=width of vanes n=layer number of a given winding $d_n$=inside diameter of layer "n"

$=d_c+2(n-1)w$ $S_n$=number of starts in layer "n"

The number of starts per winding layer are adjusted to give the same turn to turn distance for each layer so as to generate the same number of turn interstices throughout the volume of the final structure.

For convenience, the present example is designed to make $d_c$=2 w. If so, then $d_n$=2 wn. Further, $P_n$=pitch of one start of layer n $=\pi\times$turn inside diameter $=\pi\times 2$ wn N=Number of turns for each start in length L $=L/\pi\times 2$ wn $T_L$=length of one turn $=\pi\times 2$ wn$\times\sqrt{2}$ Therefore, the length of each start for all layers=$\sqrt{2}\times L$ BASIC DESIGN NUMBERS FOR A 10" O.D. UNIT
Core tube diameter = 2.00", vane width = 1", mixer active length = 98"
Winding length for all windings = √2 × 96 inches

| LAYER NO. | I.D. | TURNS/START | PITCH | STARTS | TURN SEP. |
|---|---|---|---|---|---|
| #1 | 2" | 15.28 | 6.28" | 3 | 2.09" |
| #2 | 4" | 7.64 | 12.57" | 6 | 2.09" |
| #3 | 6" | 5.09 | 18.85" | 9 | 2.09" |
| #4 | 8" | 3.82 | 25.13" | 12 | 2.09" |

Note that the turn to turn separation is a constant for all adjacent turns and all layers as is required to generate an equal number of interstices throughout the volume. Clearly, the number of starts per layer must be integral, but a very large range of the other dimensional parameters is available to achieve constant turn to turn separation.

All the principles of this invention have been discussed above in connection with several alternative embodiments, it should be understood that numerous applications of the principles may be found by those of ordinary skill in this art. Accordingly, the invention is not limited to this specific exemplary application as described above but may be employed in any situation in which a fluid is intended to be mixed and undergo simultaneous heat transfer.

We claim:

1. A device for enhancing uniformity of fluids within a moving fluid stream within the confines of a conduit, said conduit being characterized as having a substantially circular cross section, a longitudinal axis, a fluid inlet and a fluid outlet, said device comprising a core pipe located at the approximate longitudinal axis of said conduit, said core pipe acting as a mandrel for the application of least first and second layers of vanes, said first layer of vanes being helically wound about said core pipe, the inner diameter of said first layer of vanes being substantially co-extensive with the outer diameter of said core pipe wherein each of said vanes of said first layer being of substantially constant angle to said longitudinal axis and said second layer of vanes being helically wound about said first layer of vanes such that said second layer of vanes have an inner diameter substantially co-extensive with the outer diameter of said first layer of vanes and the vanes of said second layer being of a substantially constant angle to said longitudinal axis, the sign of each layer of vanes being opposite to adjacent layer of vanes so that interstices are created between adjacent layers of vanes which are substantially constant along the length of said core pipe.

2. The device of claim 1 wherein each layer of vanes is at an angle of approximately 45° to said longitudinal axis.

3. The device of claim 1 wherein interstices are created at points of contact between adjacent layers of vanes.

4. The device of claim 3 wherein vanes in adjacent layers form interstices having angles of approximately 90°.

5. The device of claim 1 wherein a fluid is contained by said core pipe.

6. The device of claim 5 wherein heat transfer occurs between said fluid within said core pipe and fluid within said conduit.

7. The device of claim 5 wherein means are provided for passing fluid from within said core pipe to fluid within said conduit, said fluids being mixed by passage over said at least first and second layers of vanes.

8. The device of claim 7 wherein said means for passing fluid from within said core pipe to fluid within said conduit comprises a series of holes configured within said core pipe.

9. The device of claim 7 wherein said means for passing fluid from within said core pipe to fluid within said conduit comprises providing a core pipe having a porous wall.

* * * * *